US008325962B2

(12) United States Patent
Ishida et al.

(10) Patent No.: US 8,325,962 B2
(45) Date of Patent: Dec. 4, 2012

(54) HEADPHONES

(75) Inventors: Hiroyuki Ishida, Tokyo (JP); Naotaka Tsunoda, Tokyo (JP)

(73) Assignee: Sony Corporation, Tokyo (JP)

( * ) Notice: Subject to any disclaimer, the term of this patent is extended or adjusted under 35 U.S.C. 154(b) by 1054 days.

(21) Appl. No.: 12/243,758

(22) Filed: Oct. 1, 2008

(65) Prior Publication Data

US 2009/0103762 A1 Apr. 23, 2009

(30) Foreign Application Priority Data

Oct. 22, 2007 (JP) ..... P2007-274000

(51) Int. Cl.
*H04R 25/00* (2006.01)

(52) U.S. Cl. ..... 381/370; 381/374; 381/378; 381/382; 381/384

(58) Field of Classification Search ..... None
See application file for complete search history.

(56) References Cited

U.S. PATENT DOCUMENTS 5,146,619 A * 9/1992 Brown ..... 455/351
5,708,725 A * 1/1998 Ito ..... 381/370
7,428,429 B2 * 9/2008 Gantz et al. ..... 455/575.1
7,885,419 B2 * 2/2011 Wahl et al. ..... 381/74
2005/0260953 A1 * 11/2005 Lefler et al. ..... 455/100
2007/0223766 A1 * 9/2007 Davis et al. ..... 381/379
2009/0154738 A1 * 6/2009 Pal ..... 381/309
2011/0116672 A1 * 5/2011 Wahl et al. ..... 381/375
2011/0206216 A1 * 8/2011 Brunner et al. ..... 381/74

FOREIGN PATENT DOCUMENTS

JP 3520531 2/2004

* cited by examiner

*Primary Examiner* — Marlo Fletcher
(74) *Attorney, Agent, or Firm* — Finnegan, Henderson, Farabow, Garrett & Dunner, L.L.P.

(57) ABSTRACT

There is provided headphones that include a pair of left and right earcups, an audio signal processing unit contained in the earcups, a headband connecting the left and right earcups respectively through a hanger, and a cord to supply a signal to the audio signal processing unit. In the headphones, a connection portion between the hanger and the headband is configured as an extension and contraction unit having a multi-stage structure including a small-diameter hollow member able to be taken in and out of a large-diameter hollow member, a part of the cord contained in the extension and contraction unit is spirally wound so as to be extended and contracted, nodes are placed respectively between the headband and the extension and contraction unit and between the hanger and the extension and contraction unit, and the respective nodes have a through-hole allowing penetration of the cord.

3 Claims, 8 Drawing Sheets

HEADPHONES

CROSS REFERENCES TO RELATED APPLICATIONS

The present invention contains subject matter related to Japanese Patent Application JP 2007-274000 filed in the Japan Patent Office on Oct. 22, 2007, the entire contents of which being incorporated herein by reference.

BACKGROUND OF THE INVENTION

1. Field of the Invention

The present invention relates to headphones.

2. Description of the Related Art

Headphones are used for a user wearing them to listen to sounds. Headphones have two (left and right) earcups each containing a loudspeaker. The both earcups are connected by a headband.

In order to drive the loudspeakers or the like of the headphones, it is necessary to provide an audio signal into the left and right earcups. As a wiring for supplying an audio signal, a distribution cord from an external connection terminal may be introduced into both of the left and right earcups, or it may be introduced into either one of the left and right earcups.

SUMMARY OF THE INVENTION

Introducing the cord into both earcups allows an audio signal to be directly supplied to the both earcups. However, because the cord hangs down from the both earcups, the cord is an annoying nuisance when wearing or removing headphones and the cord hangs down at both sides of the user's neck while wearing headphones, which makes the user uncomfortable.

On the other hand, introducing the cord into either left or right earcup can reduce the above-described annoyance from the cord and discomfort of a user because the cord comes out from one housing only.

However, in this case, it is necessary to provide an additional cord that supplies an audio signal from one earcup connected with the cord to the other earcup. Further, the positions of earcups of headphones (the positions where earcups are placed when a user wears headphones) can be adjusted so as to fit the user's head size or the like. Thus, in the placement of the signal supply cord from one earcup to the other earcup, the relationship with an earcup position adjustment mechanism becomes an issue.

As the earcup position adjustment mechanism, a slider mechanism that allows lengthening and shortening of a distance between an earcup and a headband may be used, or a head cushion connecting the left and right ends of a headband may be placed under the headband so that the head cushion is extended or contracted for adjustment as disclosed in Japanese Patent No. 3520531, for example.

In the case of using the slider mechanism, the cord connecting left and right earcups may be placed so as to bypass the slider mechanism or may be contained inside the slider mechanism.

If the cord bypasses the slider mechanism, the cord is exposed to the outside. This causes issues such as an increase in annoyance from the cord, the probability of a break in the cord where it is exposed, and the risk of snagging of the cord on another member or device.

If, on the other hand, the cord is contained inside the slider mechanism, the cord is placed being bent in a space inside the slider mechanism. Thus, the cord is not exposed to the outside, and the above issues are not likely to occur. However, because the cord moves freely inside the slider mechanism, this causes issues such as an increase in the danger of a break in the cord due to a tensile or bending stress and the possibility of snagging of the cord on another member inside the slider mechanism. In order to reduce the probability of occurrence of such issues and contain the entire length of the bent cord, the slider mechanism needs to be large in size. The larger slider mechanism causes headphones to be less portable.

On the other hand, in the case of using the head cushion rather than using the slider mechanism as disclosed in Japanese Patent No. 3520531, the cord connecting the left and right earcups can be contained inside the headband because there is no slider mechanism. However, the headband needs to be large in size so as to prevent interference with the fully extended head cushion, which causes headphones to be larger. Therefore, headphones with improved portability are desired.

In light of the foregoing, it is desired to provide novel and improved headphones capable of appropriately protecting a cord and having improved portability.

According to an embodiment of the present invention, there is provided headphones that include a pair of left and right earcups, an audio signal processing unit contained in the earcups, a headband connecting the left and right earcups respectively through a hanger, and a cord to supply a signal to the audio signal processing unit, wherein a connection portion between the hanger and the headband is configured as an extension and contraction unit having a multistage structure including a small-diameter hollow member able to be taken in and out of a large-diameter hollow member, a part of the cord contained in the extension and contraction unit is spirally wound so as to be extended and contracted, nodes are placed respectively between the headband and the extension and contraction unit and between the hanger and the extension and contraction unit, and the respective nodes have a through-hole allowing penetration of the cord.

In this structure, the extension and contraction unit can be extended by drawing the small-diameter hollow member out of the large-diameter hollow member, and the extension and contraction unit can be contracted by inserting the small-diameter hollow member into the large-diameter hollow member. Accordingly, the headphones can change its shape according to the shape of the user's head by adjusting the positions of the earcups with respect to the headband. The code connecting the left and right earcups is contained in the extension and contraction unit. This prevents the cord from being exposed to the outside. Further, the cord contained in the extension and contraction unit is spirally wound, thus having elasticity (spring properties). Therefore, when the extension and contraction unit is extended or contracted, the spiral cord is extended or contracted accordingly, thereby absorbing the change in shape due to extension or contraction. This prevents the cord from being slack and moving freely inside the extension and contraction unit. Further, the cord contained in the extension and contraction unit is introduced into the extension and contraction unit via the through-holes of the nodes placed between the headband and the extension and contraction unit and between the hanger and the extension and contraction unit. The cord is thereby introduced into the extension and contraction unit substantially linearly, thus reducing the risk of snagging on another component.

The cord may have a multi-conductor structure including at least four signal wires.

Further, the cord may have a multi-layer structure with an external coating partitioned into a plurality of parts in a direction intersecting with an axis line direction, each part including a plurality of signal wires.

The cord may have an external coating in a shape of a wide flat cable.

The part of the cord contained in the extension and contraction unit may be wound so that a short-axis direction in a cross section of the cord corresponds to a diameter direction of a spiral. In this structure, the cord contained in the extension and contraction unit is wound so that the short-axis direction in the cross section on the plane perpendicular to the axis line direction corresponds to the diameter direction of the spiral. In other words, the cord is wound so that the long-axis direction in the cross section is substantially parallel with the rotation axis of the spiral. This shortens the rotation diameter of the spiral, thereby reducing a storage space of the cord to be secured in the extension and contraction unit.

According to the embodiments of the present invention described above, it is possible to appropriately protect a cord and improve portability.

DETAILED DESCRIPTION OF THE PREFERRED EMBODIMENTS

Figure 1:
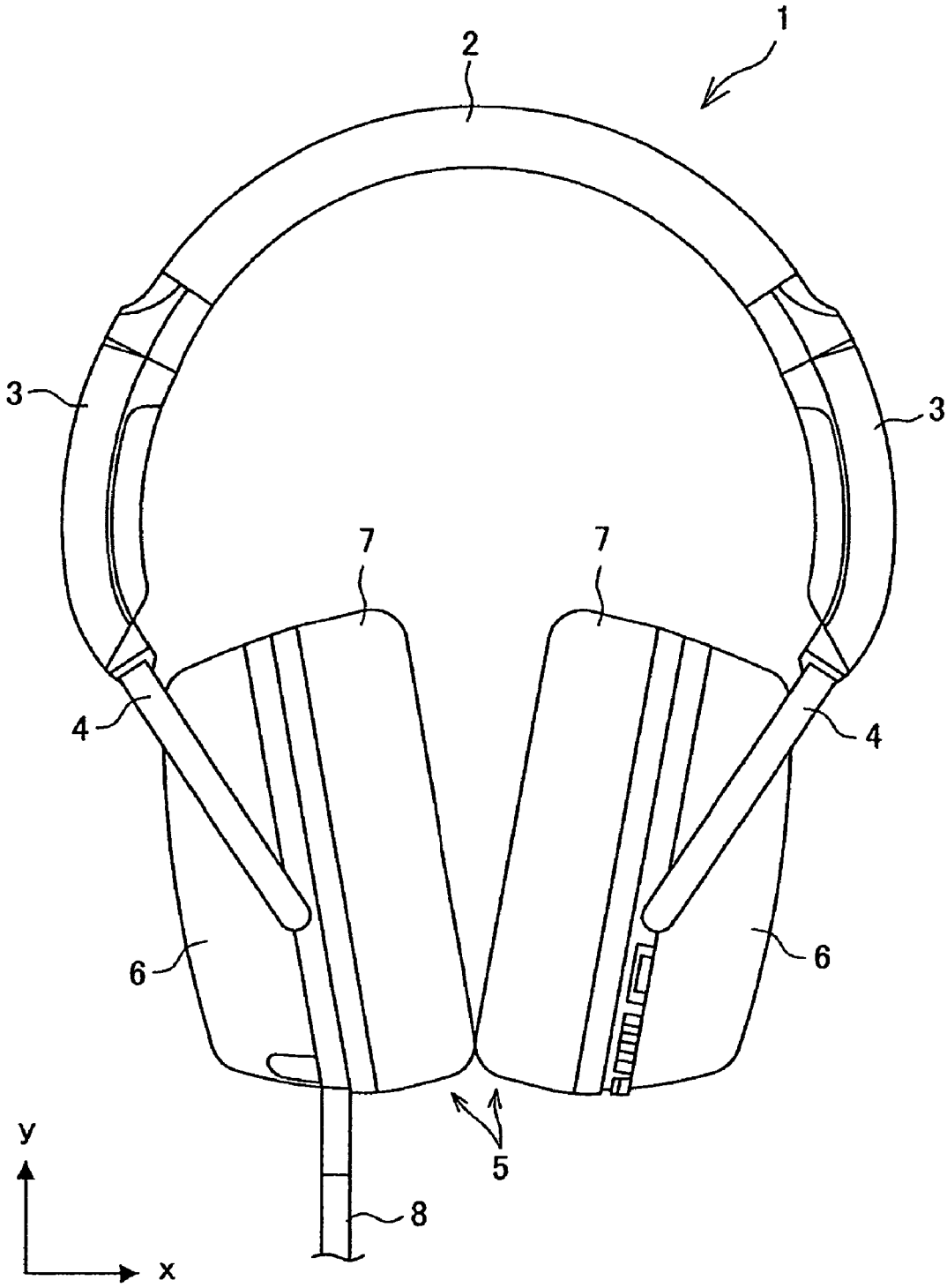
FIG. 1 is an explanatory illustration showing headphones according to embodiments of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

<Headphones>

The outline of headphones according to embodiments of the present invention is described hereinafter with reference to FIGS. 1 and 2.

Figure 2:
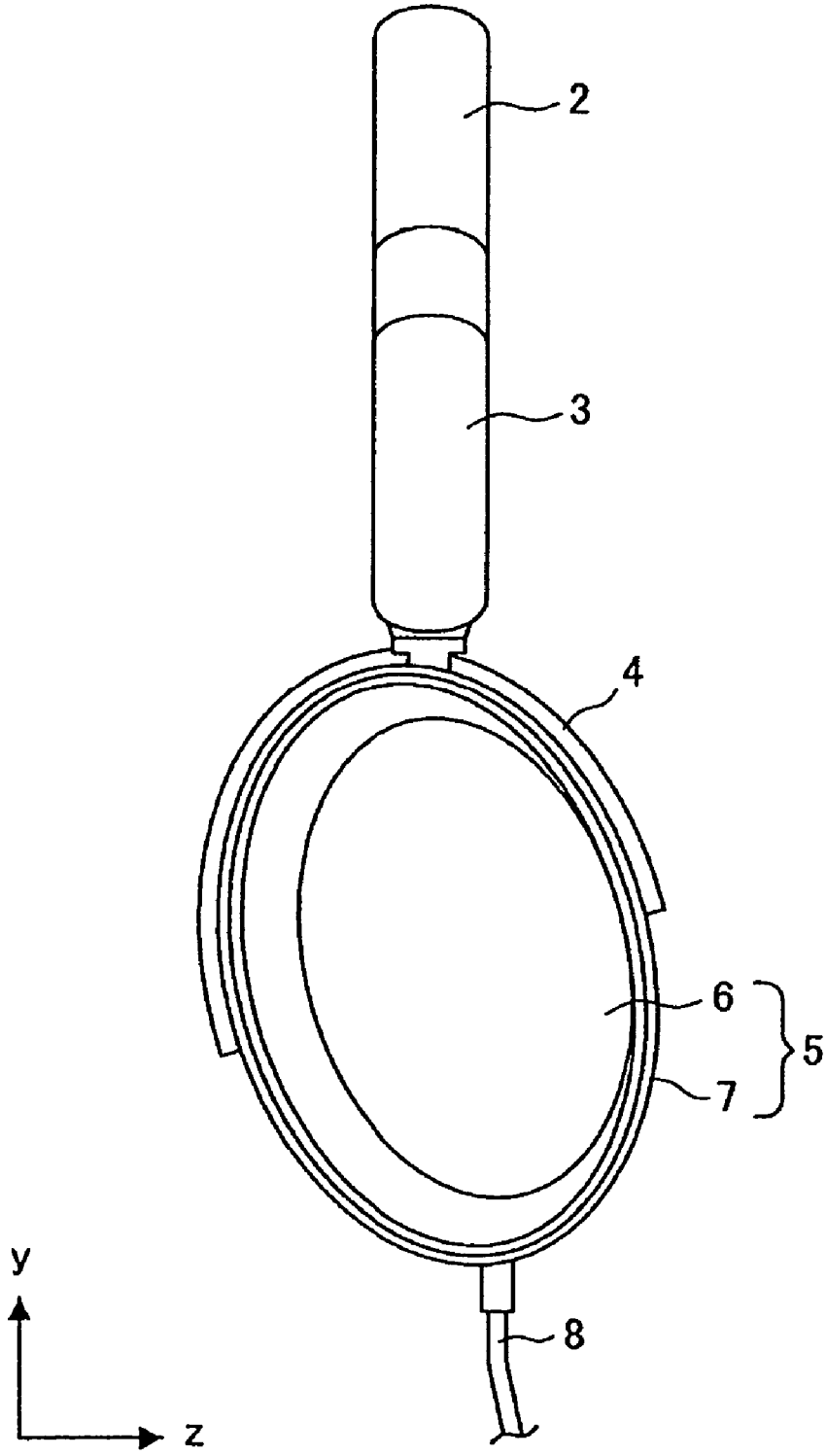
FIG. 2 is an explanatory illustration showing headphones according to embodiments of the present invention.

FIGS. 1 and 2 are explanatory illustrations showing headphones according to embodiments of the present invention. Referring to FIG. 1, headphones 1 include a headband 2, left and right sliders 3, hangers 4, earcups 5 and a cord 8.

In FIG. 1, the positive direction of the x-axis is the right direction for a user, and the positive direction of the y-axis is the upward direction for a user. In FIG. 2, the negative direction of the z-axis is the front direction for a user. Accordingly, the slider 3, the hanger 4 and the earcup 5 in the positive direction of the x-axis are for the right ear of a user, and the slider 3, the hanger 4 and the earcup 5 in the negative direction of the x-axis are for the left ear of a user.

The headband 2 is a connection member that connects the left and right sliders 3. When a user wears the headphones 1, at least part of the headband 2 usually comes into contact with the top of the user's head to thereby support the headphones 1. The headband 2 has predetermined rigidity and elasticity, and the curved shape of the headband 2 is stretched to enlarge a space between both earpads 7, so that the headphones 1 can be held on the user's head.

The sliders 3, which are one example of extension and contraction units, are sliding members that couple the headband 2 and the hangers 4 and support the hangers 4 axially slidably with respect to the headband 2. Specifically, the sliders 3 can be extended and contracted, and as a result of extension and contraction of the sliders 3, each member below the hangers 4 moves downward with respect to the headband 2. Thus, when wearing the headphones 1, extension and contraction of the sliders 3 are adjusted in accordance with the user's head size, the distance from the ears to the top of the head and so on, so that the earcups 5 are positioned opposite to the user's ears. On the other hand, when not in use, the headphones 1 can be stored with the sliders 3 being contracted, which saves a storage space. The structure of the sliders 3 is described in detail later.

The hangers 4 are rotating members that couple the sliders 3 and the earcups 5 and support the earcups 5 rotatably about a rotation axis substantially in the cross direction (the z-axis). Further, the hangers 4 are supported by the sliders 3 rotatably about a rotation axis substantially in the longitudinal direction (the y-axis). Accordingly, the hangers 4 rotate about the y-axis and also make the earcups 5 rotate about the z-axis. Thus, at the time of wearing the headphones 1, the orientation of the earcups 5 can be changed in accordance with the outer shape of the user's ears, so that the earcups 5 are positioned opposite to the ears.

The earcups 5 are members that come into contact with the user's ears to supply sounds to the user, and they include housings 6 and earpads 7 as broadly divided.

Housings 6 are housing units that contain a small loudspeaker (not shown). In the housings 6, a given electrical circuit (which is also referred to as an acoustic circuit; an example of an audio signal processing unit) or the like that performs signal processing such as sound localization, noise canceling and signal amplification on an audio signal for driving the loudspeaker may be placed. Further, a cord 8 for input signals, one end of which is connected to an input terminal (not shown), is connected to the right or left housing 6, and the other end of the cord 8 is connected to the speaker or the acoustic circuit which are contained in the housing 6.

In order to drive the loudspeaker in the housing 6 to which the cord 8 is not connected, a connection cord (not shown) is placed between the housing 6 to which the cord 8 is connected and the housing 6 to which the cord 8 is not connected. The connection cord is placed inside the hangers 4, the sliders 3 and the headband 2. In other words, an audio signal that is input to one housing 6 through the cord 8 is further input to the other housing 6 through the connection cord, thereby driving the both left and right loudspeakers. As a result of driving the loudspeakers, the audio signal is converted into a sound and supplied to the user's ears. The connection cord is configured to reduce the size of the sliders 3 and suppress the occurrence of defects such as a break. The connection cord is described in detail later.

The earpads 7 are attached to the faces of the housings 6 that are opposite to user's ears as cushioning between the housings 6 and a user's head. Because direct contact of the housings 6 that are made of a non-elastic rigid material with a user's head causes significant decrease in the comfort of a user wearing them, the elastic earpads 7 are placed to avoid direct contact of the housings 6 with a user as cushioning between them.

<Sliders>

Figure 3:
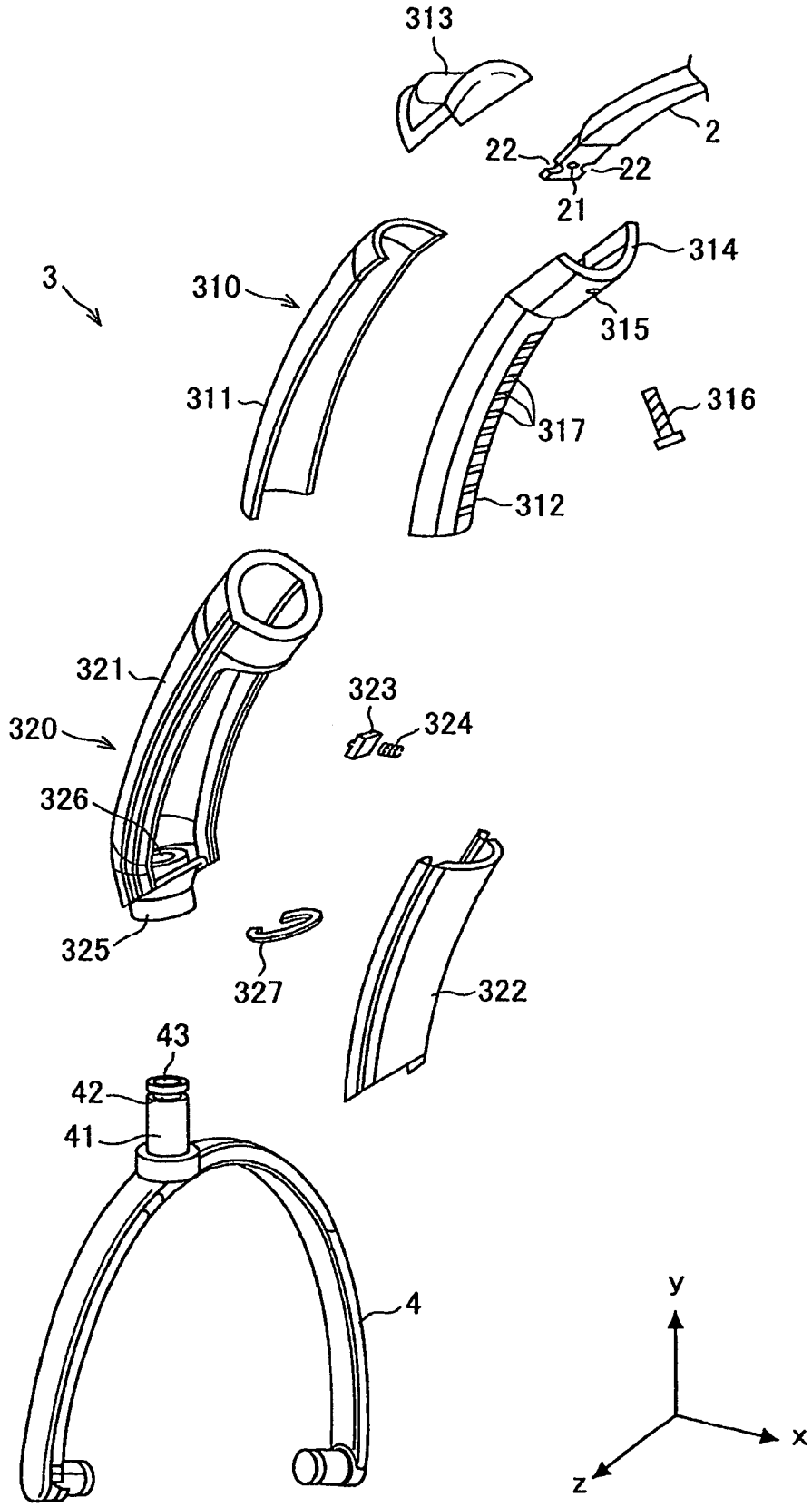
FIG. 3 is an explanatory illustration showing disassembled parts of a slider according to embodiments of the present invention.

The structure of the sliders 3 which are included in the headphones 1 according to embodiments of the present invention is described hereinafter in detail with reference to FIG. 3. FIG. 3 is an explanatory illustration showing disassembled parts of the slider according to embodiments of the present invention for the explanation of its structure.

Referring to FIG. 3, the slider 3 has an inner slider 310 and an outer slider 320 as broadly divided. The inner slider 310 is an example of a small-diameter hollow member, which has a substantially tubular shape. The outer slider 320 is an example of a large-diameter hollow member, which has a substantially tubular shape having a larger outside diameter than the inside diameter of the inner slider 310. The inner slider 310 is inserted into the hollow of the large-diameter outer slider 320 and supported being able to be taken in and out. Thus, the slider 3 has a multistage structure that is contracted and extended as the inner slider 310 comes in and out of the outer slider 320. The inner slider 310 and the outer slider 320 are both hollow. In other words, the inner slider 310 and the outer slider 320 each have a substantially linear through-hole inside. The above-described connection cord is inserted into the through-holes.

Each element is described in detail below.

The inner slider 310 includes a first inner slider 311, a second inner slider 312, a first node 313, a second node 314, and a screw 316.

The first inner slider 311 and the second inner slider 312 each have a shape that axially breaks up one tube into two pieces, for example, and they form a part of the inner slider 310 when engaged with each other. The second inner slider 312 is placed on the near side of a user's head, and the first inner slider 311 is placed on the far side of a user's head.

The second node 314 is formed integrally with the second inner slider 312 on the axial upside of the second inner slider 312. The second node 314 has a fastening hole 315 from the user's head side to the outside. The first node 313 is formed to be engageable with the second node 314, and a female thread (not shown) is cut in the position corresponding to the fastening hole 315 in the first node 313. The first node 313 and the second node 314 are engaged with each other with the end of the headband 2 interposed therebetween.

At this state, a groove 22 that is cut in the headband 2 in the cross direction is engaged with a protrusion (not shown) that is formed inside the second node 314, thereby determining the positional relationship of the headband 2 and the second node 314. The screw 316 penetrates the through-hole 21 of the headband 2 and the fastening hole 315 of the second node 314 and tightly fits the female thread of the first node 313, thereby fixing the headband 2. The first node 313 and the second node 314 form a hollow, substantially tubular shape when they are engaged with each other. The hollow is substantially linear with the hollow of the inner slider 310, creating one through-hole.

On the other hand, the outer slider 320 includes a first outer slider 321, a second outer slider 322, a latch member 323, a spring 324 and a ring 327.

The first outer slider 321 has a substantially tubular shape having an opening partly on the user's head side and a through-hole in the longitudinal direction (the axis direction of the slider 3). The second outer slider 322 is a cover that covers the opening of the first outer slider 321. Thus, the first outer slider 321 and the second outer slider 322 form a part of one substantially tubular outer slider 320 when they are engaged with each other. The inner slider 310 is inserted into the hollow of the first outer slider 321.

On the user's head side surface of the second inner slider 312 to be inserted, a plurality of recess-shaped notches 317, each formed in the cross direction (the z-axis direction; the front-to-rear direction of a user), are placed along the axis direction of the slider 3. On the other hand, on the inner surface of the second outer slider 322 to receive insertion that faces the first outer slider 321, a latch member 323 is placed with the spring 324 placed therebetween. The latch member 323 has a protrusion that is formed in the cross direction so as to correspond to the notch 317. Thus, when the inner slider 310 is inserted into the outer slider 320, the protrusion of the latch member 323 is pressed toward the inner slider 310 by an elastic force of the spring 324 and thereby engaged with the recess-shaped notch 317. By such a latch mechanism, the positional relationship between the inner slider 310 and the outer slider 320 is fixed (cf. FIG. 6). By selecting the notch 317 to be engaged with the latch member 323 from the plurality of notches 317, the slider 3 can be fixed in the extended or contracted position.

On the axial downside of the first outer slider 321, a node 325 is formed integrally with the first outer slider 321. The node 325 has a through-hole 326 that is substantially linear with the through-hole of the substantially tubular first outer slider 321.

On top of the hanger 4 that supports the earcup 5, a substantially cylindrical protrusion 41 having an outside diameter corresponding to the inside diameter of the through-hole 326 is formed, and the protrusion 41 is inserted into the through-hole 326 of the node 325. The protrusion 41 has a groove 42 at the upper end of its side surface, and the ring 327 is engaged with the groove 42 when the protrusion 41 is inserted into the through-hole 326. The thickness of the ring 327 in the diameter direction is larger than the depth of the groove 42, and the hanger 4 is fixed to the slider 3 by the ring 327. The protrusion 41 also has a through-hole 43 in the axis direction (the longitudinal direction).

The above-described connection cord passes through the inside of the earcup 5 and the inside of the hanger 4 and comes out from the through-hole 43 of the protrusion 41. Further, the connection cord penetrates the through-hole 326 of the node 325, passes through the inside (the through-hole) of the outer slider 320 and then substantially linearly enters the inside (the through-hole) of the inner slider 310. After passing through the inside of the inner slider 310, the connection cord passes through the through-hole between the first node 313 and the second node 314 and thereby enters the inside of the headband 2.

Although FIG. 3 shows the structure of the slider 3 and so on for the left ear, the structure of the slider 3 and so on for the right ear is identical except that they are the mirror images of the left ones. Thus, after passing through the inside of the headband 2, the connection cord passes through the inside of the slider 3 and so on for the right ear in the same manner and enters the other earcup 5.

<Connection Code According to the First Embodiment>

Figure 4:
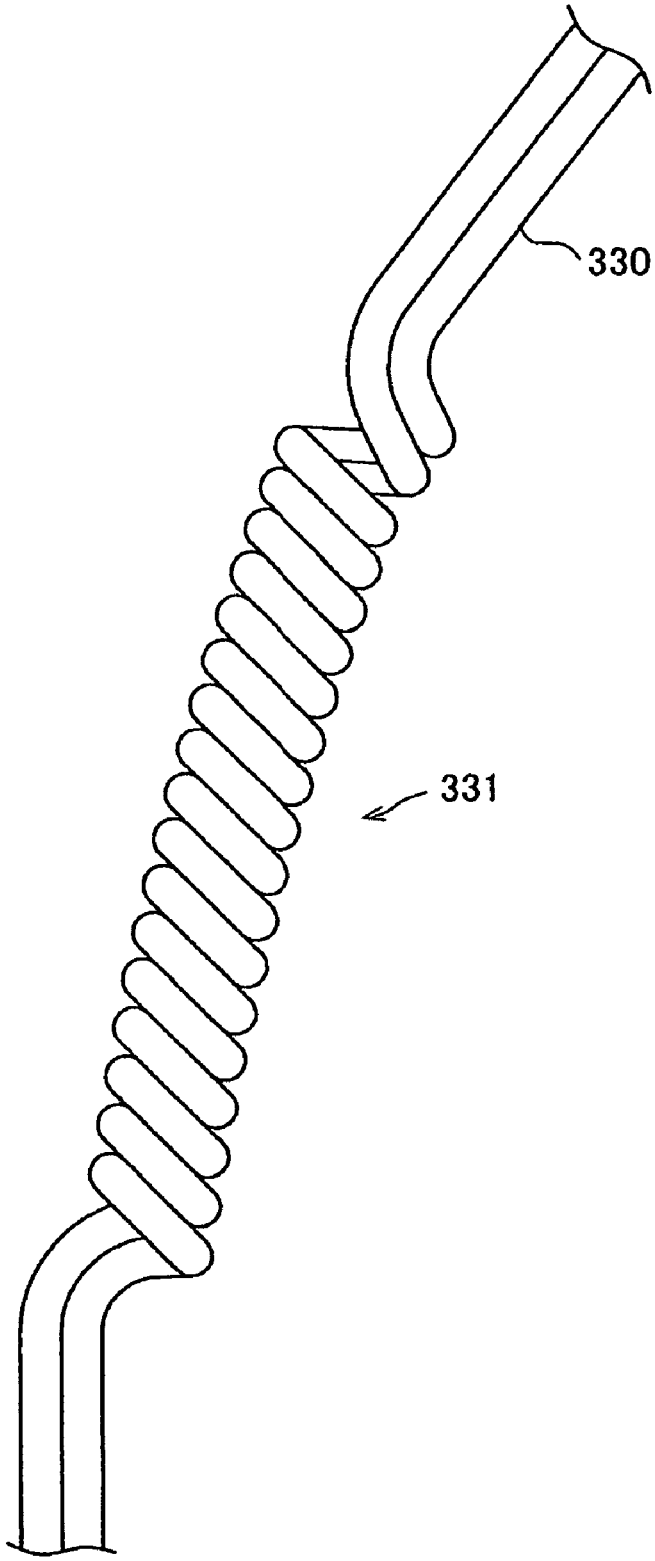
FIG. 4 is an explanatory illustration showing a connection cord of headphones according to a first embodiment of the present invention.
Figure 5:
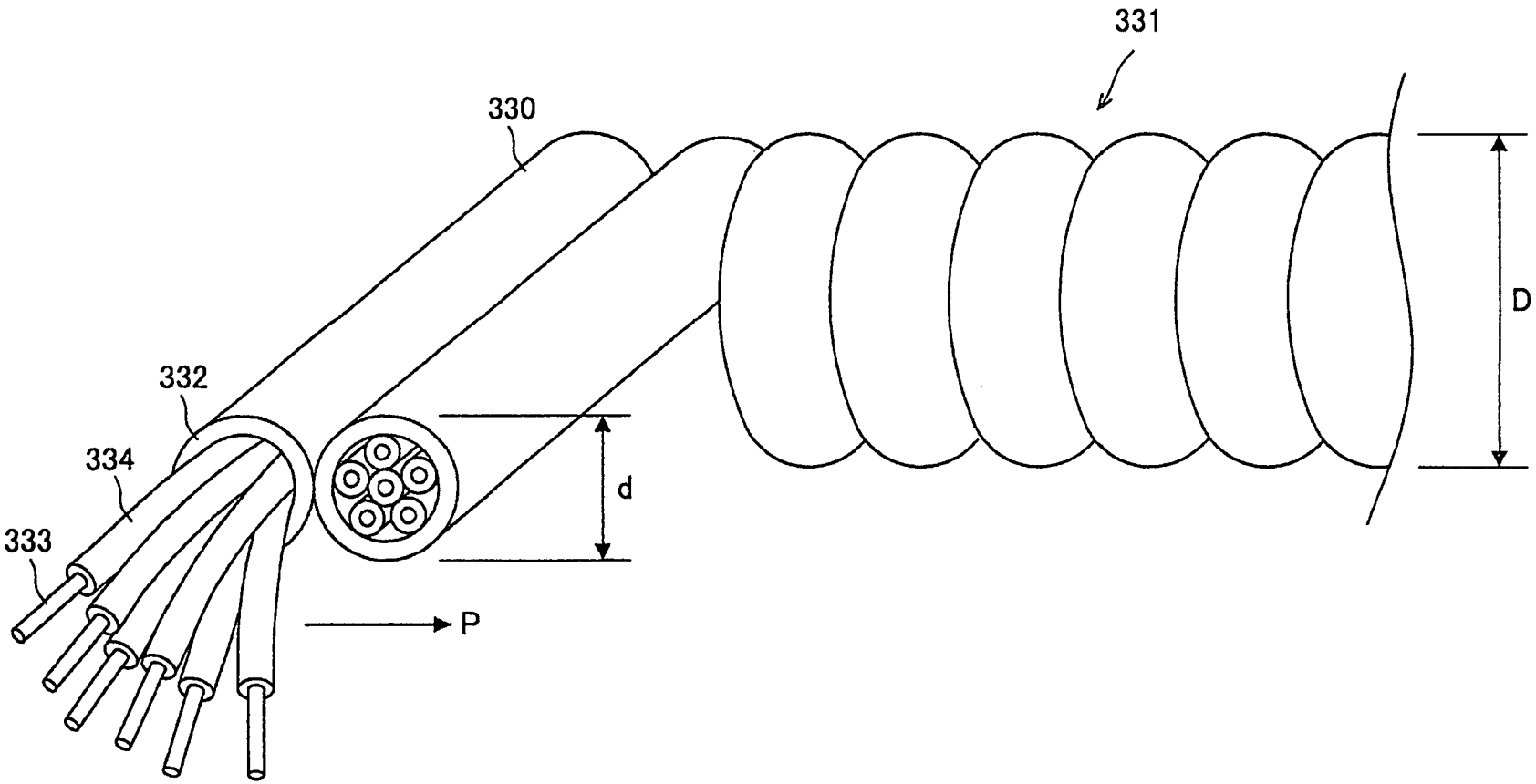
FIG. 5 is an explanatory illustration showing a connection cord of headphones according to the first embodiment.

A connection code that is included in the headphones 1 according to a first embodiment of the present invention is described hereinbelow with reference to FIGS. 4 and 5. FIGS. 4 and 5 are explanatory views showing the connection cord of the headphones according to the first embodiment of the present invention. FIG. 4 illustrates a part of the connection cord on the left ear side, and FIG. 5 illustrates the cross-section of a part of the connection cord as well.

A connection cord 330 is an example of a cord that supplies a signal to an acoustic circuit placed inside the housing 6 of the earcup 5. The connection cord 330 electrically connects the left and right earcups 5, and it is configured such that two codes are joined along the axis line. Referring to FIG. 5, the connection cord 330 has a multi-conductor structure such as a 12-conductor cord. An acoustic circuit of recent headphones performs signal processing such as sound localization, noise canceling and signal amplification, for example, as described earlier. Therefore, it is necessary for the connection cord to have a plurality of wires in addition to a wire for audio signals. Thus, the connection cord has 12 conductors in this embodiment.

Specifically, the connection cord 330 includes 12 signal wires 333, and each signal wire 333 is covered with an internal coating 334. The signal wires 333 are tied into a bundle of 6 wires, which is covered with an external coating 332. Thus, the connection cord 330 has a multi-layer structure. In other words, the external coating 332 is partitioned into two parts in the direction intersecting with the axis line direction, and 6 wires of the signal wires 333 are placed in each part. The internal coating 334 and the external coating 332 are insulating coatings.

The connection cord 330 partly has a spiral portion 331 with a spiral winding shape, which is an example of an extension and contraction unit. The connection cord 330 can be extended and contracted by the spiral portion 331. Specifically, the external coating 332 of the connection cord 330 is partitioned into two parts in the direction intersecting with the axis line direction as described above, and the spiral portion 331 winds in such a way that the partitioned direction (the direction P in FIG. 5), which is the long-axis direction of the cross section of the connection cord 330, is substantially parallel with the axis of the spiral. Because the spiral portion 331 winds in this manner, the winding radius of the spiral portion 331 is small.

In the case of spirally winding the cord, if the thickness of the cord in the diameter direction of the spiral is d, a length that is about three times the thickness d of the cord should be secured for the diameter D of the spiral. In this embodiment, the cord is placed in such a way that the short-axis direction of the cross section (i.e. the direction with a smaller thickness) corresponds to the thickness d of the cord in the diameter direction of the spiral, thereby shortening the rotation diameter of the spiral. Particularly, in the case of using the connection cord having a multi-conductor structure as in this embodiment, the diameter of the connection cord is so large that the diameter of the spiral portion is large in spite of having a spiral shape. However, because the connection cord 330 of this embodiment is wound in such a way that the short-axis direction of the cross section corresponds to the diameter direction of the spiral, the diameter of the spiral portion 331 is small. This reduces the overall size of the headphones 1, thereby improving portability.

The structure and the operation of the slider 3 which is assembled with the connection cord 330 placed inside are described hereinafter with reference to FIGS. 6 and 7.

Figure 6:
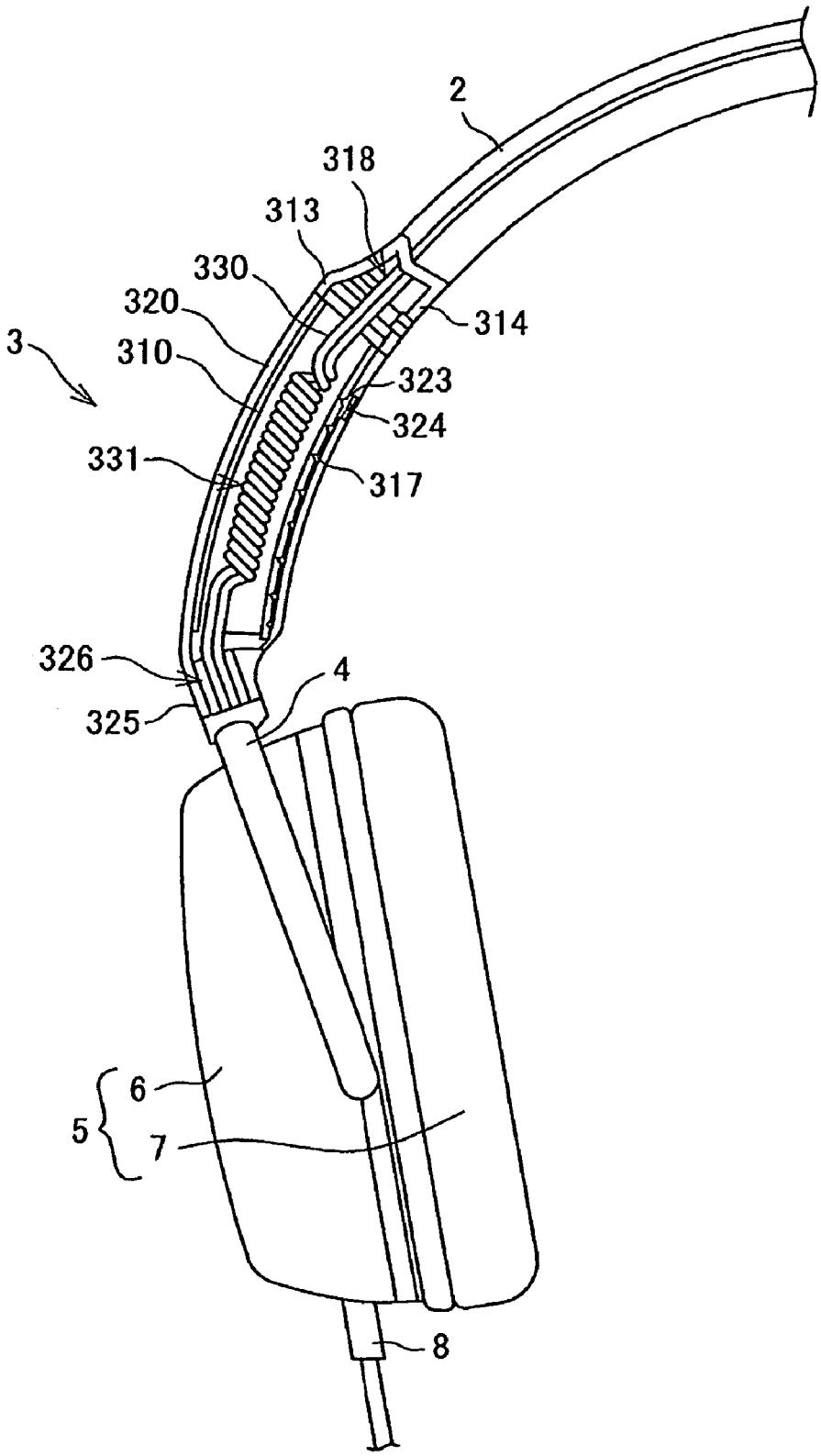
FIG. 6 is an explanatory illustration showing the internal structure of a slider according to the first embodiment.
Figure 7:
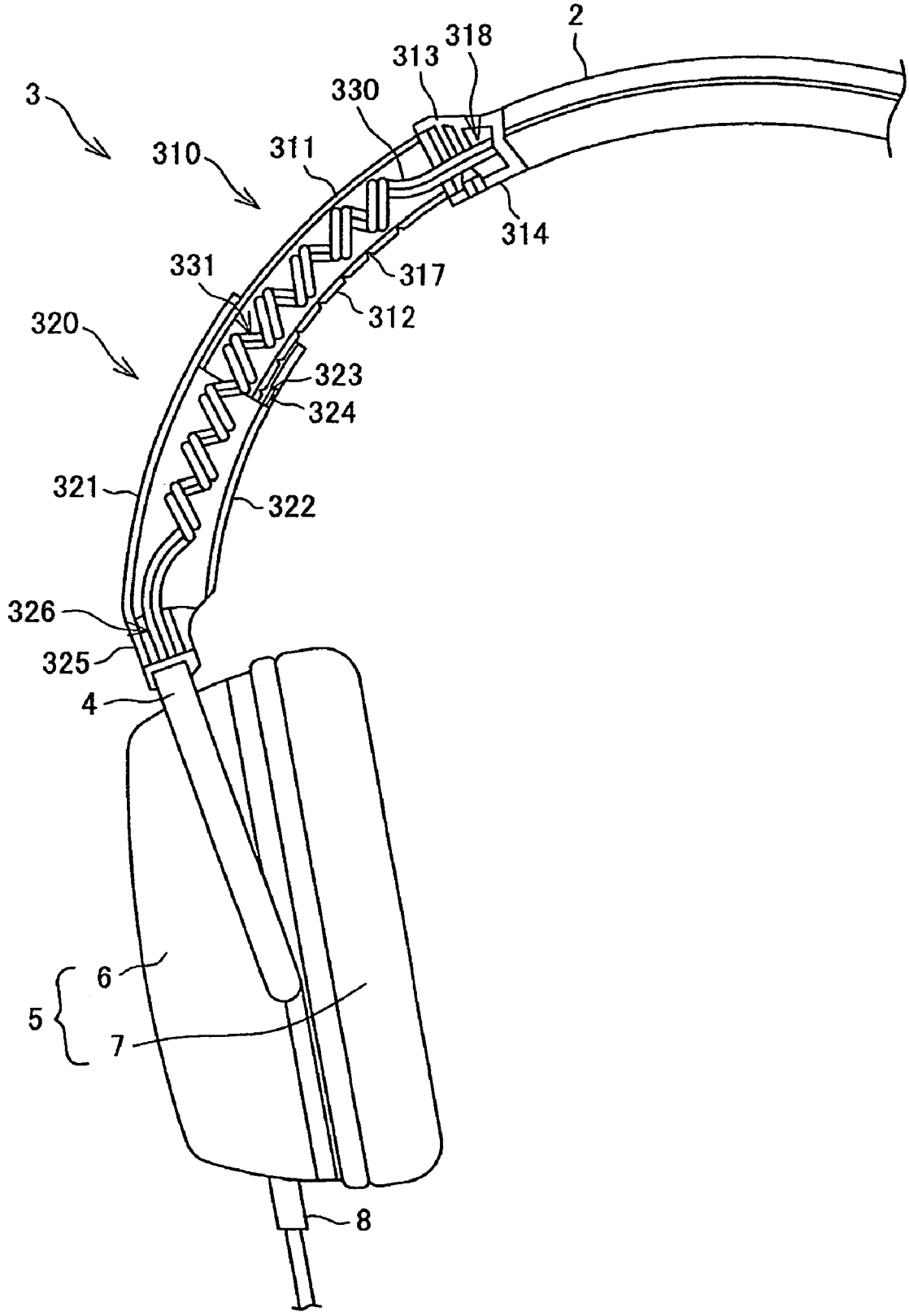
FIG. 7 is an explanatory illustration showing the internal structure of a slider according to the first embodiment.

FIGS. 6 and 7 are explanatory views showing the internal structure of the slider according to this embodiment. FIG. 6 illustrates the state where the slider 3 is contracted, and FIG. 7 illustrates the state where the slider 3 is extended. FIGS. 6 and 7 show the slider 3 and so on for the left ear. The slider 3 and so on for the right ear are the mirror images of the ones shown in FIGS. 6 and 7 and operate in the same manner, and they are thus not described in detail hereinbelow.

Referring to FIG. 6, the connection cord 330 is introduced into the slider 3 through the earcup 5 and the hanger 4. At this point, the connection cord 330 passes through the through-hole 326 of the node 325. Further, the connection cord 330 passes through the through-hole of the inner slider 310 that is inserted into the outer slider 320 and an upper through-hole 318 between the first node 313 and the second node 314 and then enters the headband 2. The connection cord 330 is placed in such a way that the spiral portion 331 is positioned inside the slider 3.

The part of the connection cord 330 above the spiral portion 331 is fixed to the first node 313 and/or the second node 314, and the part of the connection cord 330 below the spiral portion 331 is fixed to the node 325.

Accordingly, referring to FIG. 7, if the inner slider 310 is drawn out of the outer slider 320 and the slider 3 is extended, the spiral portion 331 of the connection cord 330 that is placed inside the slider 3 is stretched. Thus, the spiral portion 331 is extended and contracted according to extension and contraction of the slider 3, so that the slider 3 can be configured to be capable of extension and contraction. Further, because the spiral portion 331 is elastic, the spiral portion 331 can be contracted when the slider 3 is contracted as shown in FIG. 6. A change in length due to extension and contraction of the slider 3 is absorbed by extension and contraction of the spiral portion 331 of the connection cord 330. Because of its elasticity, the spiral portion 331 does not expand to be larger than the diameter D of the spiral, and it is less subject to a bending stress due to extension and contraction of the slider 3. Accordingly, the connection cord 330 reduces the possibility of occurrence of defects that the cord gets snagged on another member by being slack and freely moving inside the slider or it is broken due to a tensile or bending stress, and so on. Further, the spiral portion 331 is contained inside the slider 3, and the other parts of the connection cord 330 are also contained inside the headphones 1. Therefore, the connection cord 330 is not exposed to the outside, thereby reducing annoyance from the cord and the risk of a break in the cord.

As described in the foregoing, according to this embodiment, the slider 3 having a multistage structure that can be extended and contracted is provided, and the connection cord 330 is placed inside the slider 3, thereby reducing annoyance from the cord and the risk of a break in the cord. Further, the connection cord 330 has the spiral portion 331 in the position inside the slider 3 that is extended and contracted, thereby reducing play (such as slack) of the connection cord 330 and lowering the risk of a break in the cord due to an external impact or the risk of snagging of the cord on another component. Furthermore, the connection cord 330 is placed substantially linearly via the through-holes 318 and 326 of the upper and lower nodes as shown in FIGS. 6 and 7, thereby further reducing the risk of snagging of the connection cord 330 on another component and shortening the overall length of the connection cord 330. Besides, the spiral portion 331 of the connection cord 330 is wound so that the short-axis direction corresponds to the diameter direction of the spiral, thereby reducing the diameter of the spiral and reducing the cross-sectional area of the through-hole, which is a portion to contain the connection cord 330 that is made in the slider 3. It is thereby possible to reduce the size of the slider 3 and consequently downsize the headphones 1 and improve portability.

Although the case where the external coating 332 of the connection cord 330 is partitioned into two parts is described in the above embodiment, the external coating 332 may be partitioned into three or more parts. In such a case, the number of the signal wires 333 that are placed in each part is preferably substantially equal, for example.

The first embodiment of the present invention is described in the foregoing.

In the following, a second embodiment of the present invention is described with reference to FIG. 8. In the headphones according to this embodiment, the elements other than the connection cord 330 are the same as those of the headphones 1 according to the first embodiment and thus not described in detail hereinbelow.

<Connection Cord According to the Second Embodiment>

Figure 8:
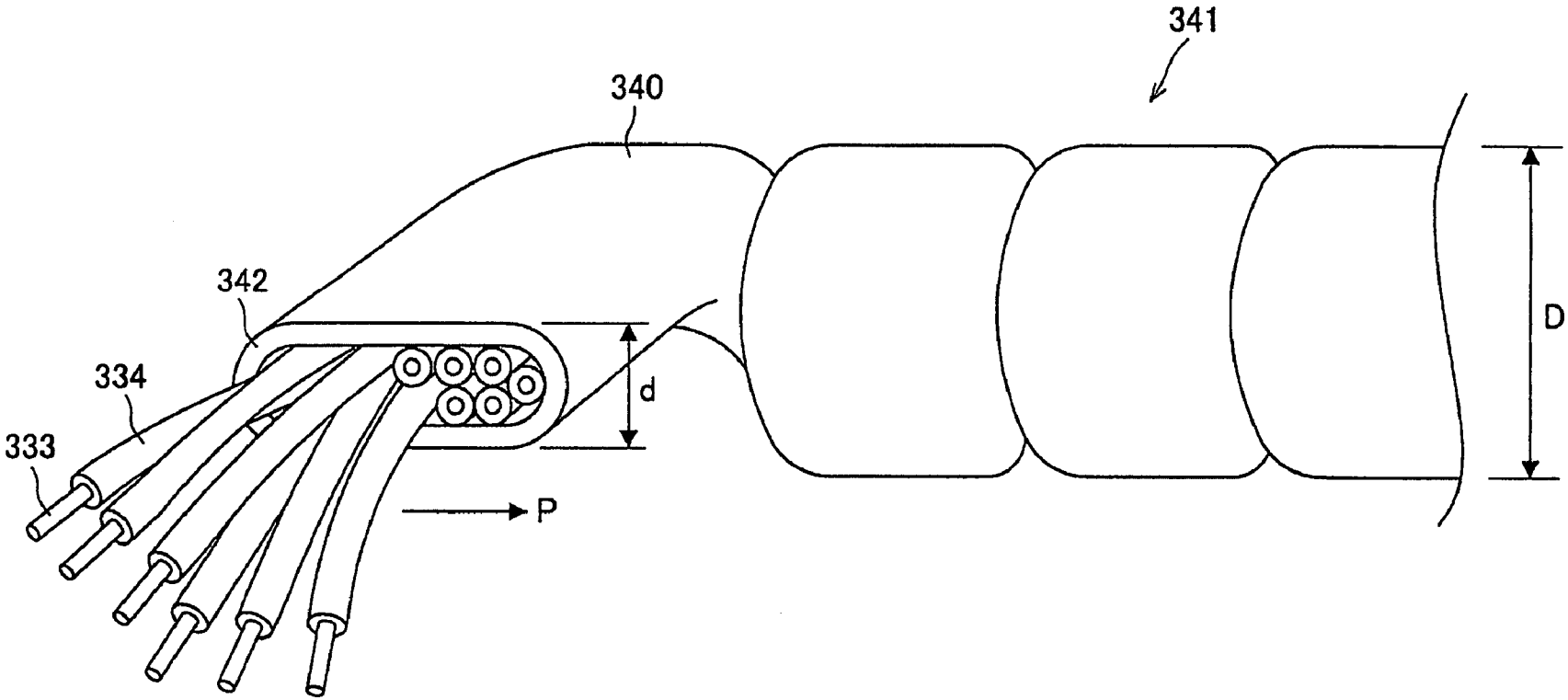
FIG. 8 is an explanatory illustration showing a connection cord of headphones according to a second embodiment of the present invention.

FIG. 8 is an explanatory illustration showing the connection cord of the headphones according to the second embodiment of the present invention. FIG. 8 illustrates the cross-section of a part of the connection cord as well.

A connection cord 340 is an example of a cord that supplies a signal to an acoustic circuit placed inside the housing 6 of the earcup 5, which electrically connects the left and right earcups 5. The connection cord 340 has a shape of a wide flat cable as shown in FIG. 8. Specifically, the connection cord 340 has a flat shape whose cross section on the plane intersecting with the axial line direction has the long-axis side (the side parallel with the direction P in FIG. 8) and the short-axis side (the side having the thickness d in FIG. 8). The connection cord 340 has a multi-conductor structure such as a 12-conductor cord, just like the connection cord 330 according to the first embodiment described above.

Specifically, the connection cord 340 includes 12 signal wires 333, and each signal wire 333 is covered with an internal coating 334. The signal wires 333 are further covered with one external coating 342. Thus, the connection cord 340 has a multi-layer structure, just like the connection cord 330 according to the first embodiment. The external coating 332 is also an insulating coating.

The connection cord 340 also partly has a spiral portion 341 with a spiral winding shape. Thus, the connection cord 340 can be extended and contracted by the spiral portion 341. Specifically, the external coating 342 of the connection cord 340 is shaped like a flat cable as described above, and the spiral portion 341 winds in such a way that the long-axis direction (the direction P in FIG. 8) of the flat cable shape is substantially parallel with the axis of the spiral. In other words, the spiral portion 341 winds in such a way that the short-axis direction (the direction of the thickness d in FIG. 8) corresponds to the diameter direction of the spiral (the direction of the diameter D in FIG. 8). Because the spiral portion 341 winds in this manner, the winding radius of the spiral portion 341 is small.

In this embodiment, like the first embodiment, the connection cord 340 is contained inside the headphones 1 so that the spiral portion 341 is placed inside the slider 3. Therefore, the connection cord 340 according to this embodiment has the same function and advantage as the first embodiment.

It should be understood by those skilled in the art that various modifications, combinations, sub-combinations and alterations may occur depending on design requirements and other factors insofar as they are within the scope of the appended claims or the equivalents thereof.

For example, although the outer slider 320 of the slider 3 has the second outer slider 322 in the embodiments described above, the present invention is not limited thereto. For example, the outer slider 320 may not have the second outer slider 322. In this case, the latch member 323 and the spring 324 are placed inside the first outer slider 321.

Further, although the inner slider 310 and the outer slider 320 have a substantially tubular shape in the embodiments described above, the present invention is not limited thereto. The inner slider 310 and/or the outer slider 320 may have any shape that creates a space for containing the connection cord 330, and it may have a circular, rectangular, triangular or rhomboid cross section, for example.

In the embodiments described above, the connection cord has multiple conductors, and a 12-conductor cord is described as an example. However, the present invention is not limited thereto. If, particularly, the connection cord has 4 or more conductors, the diameter of the spiral portion can be reduced according to the above-described embodiments, which is advantageous. On the other hand, if the connection cord has 1, 2 or 3 conductors, the external coating 332 is not always necessary, and the connection cord may be a flat cable in which the signal wires 333 are connected along the axis line. In this case also, the spiral portion of the connection cord winds in such a way that the direction with a smaller thickness corresponds to the diameter direction of the spiral.

Alternatively, the signal wire 333 that is formed by twisting several to several tens of UEW wires (polyurethane copper wires), for example, pre-covered with the internal coating may be used as the connection cord. In this case, the internal coating 334 may be eliminated. If the connection cord does not have the internal coating 334, the thickness d of the cord shown in FIGS. 4 and 5 decreases, so that the diameter D of the spiral decreases. Further, the connection cord that combines the signal wire with the internal coating 334 and the signal wire without the internal coating 334 depending on a signal to flow through the signal wires 333 may be used.

Although the cross-sectional shape of one part of the external coating 332 is substantially circular in the first embodiment and the cross-sectional shape of the external coating 342 is substantially rectangular with semicircular short-sides in the second embodiment, the present invention is not limited thereto. For example, the external coating 332 may have an elliptical, rectangular, rhomboid, trapezoidal or parallelogram cross section. In this case, the external coating 332 is preferably formed to have a cross section with a long-axis side and a short-axis side.

What is claimed is:

1. Headphones comprising:

a pair of left and right earcups;

an audio signal processing unit contained in each of the earcups;

a headband connecting the left and right earcups respectively through a hanger;

a first cord having a first end and a second end, wherein the first end is configured to be connected to an external input terminal and the second end is connected to one of the audio signal processing units;

a second cord connected to each audio signal processing unit and extending through the headband, wherein the second cord has a multi-conductor structure including at least four signal wires, such that the second cord has a multi-layer structure with an external coating partitioned into a plurality of parts in a direction intersecting with an axis line direction, each part including a plurality of signal wires;

a connection portion between the hanger and the headband configured as an extension and contraction unit having a multistage structure including a small-diameter hollow member able to be taken in and out of a large-diameter hollow member, wherein a portion of the second cord is contained in the extension and contraction unit and is spirally wound so as to be extended and contracted, and wherein nodes are placed respectively between the headband and the extension and contraction unit and between the hanger and the extension and contraction unit, each of the respective nodes having a through-hole allowing penetration of the second cord.

2. The headphones according to claim 1, wherein the second cord has an external coating in a shape of a flat cable.

3. The headphones according to claim 1, wherein the portion of the second cord contained in the extension and contraction unit is wound so that a short-axis direction in a cross section of the second cord corresponds to a diameter direction of a spiral.

* * * * *